US005785197A

United States Patent [19]

Slat

[11] Patent Number: 5,785,197

[45] Date of Patent: Jul. 28, 1998

[54] REINFORCED CENTRAL BASE STRUCTURE FOR A PLASTIC CONTAINER

[75] Inventor: William A. Slat, Brooklyn, Mich.

[73] Assignee: Plastipak Packaging, Inc., Plymouth, Mich.

[21] Appl. No.: 627,674

[22] Filed: Apr. 1, 1996

[51] Int. Cl.[6] ..... B65D 1/02

[52] U.S. Cl. ..... 215/375; 215/373; 220/606; 220/608

[58] Field of Search ..... 215/371, 372, 215/373, 374, 375; 220/604, 605, 606, 608

[56] References Cited

U.S. PATENT DOCUMENTS

| | | | |
|---|---|---|---|
| D. 362,182 | 9/1995 | Hestehave et al. . | |
| 4,108,324 | 8/1978 | Krishnakumar et al. | 215/373 |
| 4,231,483 | 11/1980 | Dechenne et al. | 215/373 X |
| 4,525,401 | 6/1985 | Pocock et al. | 215/373 X |
| 4,598,831 | 7/1986 | Nakamura et al. | 215/373 |
| 4,798,300 | 1/1989 | Ghosh et al. | 215/373 X |
| 4,850,493 | 7/1989 | Howard, Jr. | 215/375 |
| 4,993,567 | 2/1991 | Eberle, Jr. | 220/608 |
| 4,997,692 | 3/1991 | Yoshino | 215/373 X |
| 5,064,080 | 11/1991 | Young et al. | 215/375 |
| 5,205,434 | 4/1993 | Brunson et al. | 220/608 |
| 5,320,230 | 6/1994 | Hsiung | 215/375 |
| 5,503,283 | 4/1996 | Semersky | 220/608 |

FOREIGN PATENT DOCUMENTS

| | | | |
|---|---|---|---|
| 2509583 | 9/1975 | German Dem. Rep. | 220/608 |

*Primary Examiner*—Stephen J. Castellano
*Attorney, Agent, or Firm*—Bachman & LaPointe, P.C.

[57] ABSTRACT

A plastic container of the present invention comprises a neck portion defining an opening, a shoulder portion continuous with the neck portion, and an intermediate sidewall portion continuous with the shoulder portion. The intermediate sidewall portion defines a major portion of a volume for holding a content. A base portion is also provided which is continuous with the intermediate sidewall portion. The base portion has a structure for supporting the container on a support surface and a surface feature for enhancing the strength of the structure. In a preferred embodiment, the structure is preferably comprised of one of a circumferential support ring and a plurality of circumferentially positioned feet. The surface feature for enhancing strength is substantially centered with respect to the structure. The surface feature for enhancing strength preferably comprises an indentation having a strength enhancing surface texture.

14 Claims, 2 Drawing Sheets

REINFORCED CENTRAL BASE STRUCTURE FOR A PLASTIC CONTAINER

BACKGROUND OF THE INVENTION

This invention is directed to containers, and more particularly, to a container having a base portion with a structural formation thereon for enhancing the strength of the base portion.

Beverage containers are typically comprised of four sections or portion continuous with each other for forming the overall structure of the container. Accordingly, the container includes a neck portion which generally includes a flange and a threaded surface for engaging a closure; a shoulder portion continuous with the neck portion wherein the shoulder portion is typically funnel shaped, incrementally increasing the diameter of the container from the narrow neck portion to the intermediate side wall portion; the intermediate side wall portion, which is continuous with the shoulder portion and defines a major portion of the volume of the container and which is typically cylindrical in shape; and a base portion substantially continuous with the intermediate side wall portion which typically includes a support structure for adequately supporting the container on the support surface. The base portion may includes a plurality of feet or may be in the form of a continuous circumferential support ring. In both of these instances, the base portion has a bottom surface which is adapted to rest against a support surface. The bottom surface, for molding purposes, generally includes an indent extending into the volume defined by the portions of the container and toward the neck portion.

With this known structure, base portions can be insufficient in strength for adequately supporting the container while the container is filled with a content. That is, the base portion in the prior art containers are subject to radial deformation which can ruin the capacity of the container to be supported upright on the support surface.

There exists a need, therefore, for a base portion including a means for enhancing the overall strength of the base portion and the ability of the base portion to withstand radial loads.

SUMMARY OF THE INVENTION

The primary object of this invention is to provide a container having a base portion with a structural design which enhances the strength of the base portion as compared to known containers of similar structure.

Another object of this invention is to provide a container having a base portion for supporting the container on a support surface, which base portion includes a structural formation which enhances the strength of the base portion.

Still another object of this invention is to provide a container having a base portion including either a plurality of feet or a circumferential support ring for supporting the container, wherein the base portion further includes an indent central to the feet or circumferential support ring wherein the indent includes a surface structure which enhances the overall strength of the base portion.

Still another object of this invention is to provide a container having a base portion including a plurality of feet or a support ring for supporting a container and an indent extending into the volume defined by the container, which indent is centrally positioned with regard to the plurality of feet or circumferential ring and includes a plurality of linear surface deformations which enhance the strength of the base portion.

And still another object of this invention is to provide a container having a base portion formed from one of a plurality of feet or a circumferential support ring and an indent positioned centrally with relation to the feet and support ring, which indent includes a plurality of grooves or ribs extending outwardly from a central point and toward the outer wall of the container for enhancing the strength of the base portion.

The objects and advantages set forth herein are achieved by the plastic container of the present invention which comprises a neck portion defining an opening; a shoulder portion continuous with the neck portion; an intermediate sidewall portion continuous with the shoulder portion, the intermediate sidewall portion defining a major portion of a volume for holding a content; and a base portion continuous with the intermediate sidewall portion, the base portion having a structure for supporting the container on a support surface and means for enhancing the strength of the structure.

In one embodiment, the structure is preferably comprised of one of a circumferential support ring and a plurality of circumferentially positioned feet, wherein the means for enhancing strength is substantially centered with respect to the structure. The means for enhancing strength preferably comprises an indentation having a strength enhancing surface texture.

The details of the present invention are set out in the following description and drawings wherein like reference characters depict like elements.

DETAILED DESCRIPTION OF THE PREFERRED EMBODIMENT

Figure 1:
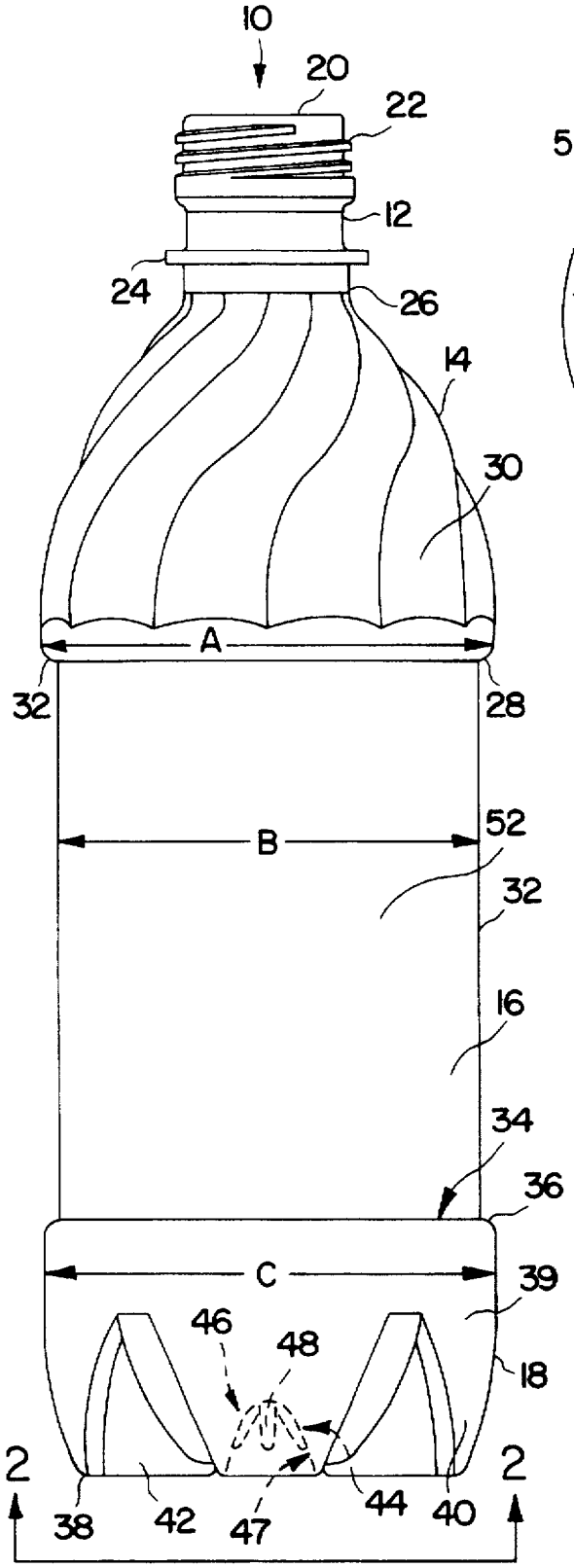
FIG. 1 is an elevational view of a container in accordance with the principles of the present invention.

Referring now to the drawings in detail there is shown in FIG. 1 an elevational view of the container of the present invention, which is designated generally as 10. Container 10 includes neck portion 12, shoulder portion 14, intermediate side wall portion 16 and base portion 18.

Neck portion 12 is preferably substantially cylindrical in shape having an opening 20 for the flow therethrough of contents adapted to be held by container 10. Neck portion 12 preferably has a threaded portion 22 on the external surface thereof for engagement with a closure (not shown) for sealing in content gases and maintaining content freshness. Neck portion 12 also preferably includes a circular flange 24 positioned below threaded portion 22 which may be used for gripping or holding the container. Neck portion 12 is continuous with shoulder portion 14.

Shoulder portion 14 extends from lower end 26 of neck portion 12 and incrementally outwardly therefrom, having a funnel shape. Accordingly, container 10 preferably tapers inwardly from bottom end 28 of shoulder portion 14 to lower end 26 of neck portion 12. Shoulder portion 14 may have a contoured surface for ornamental purposes and for facilitating improved griping of the container. Preferably, the contoured surface comprises a plurality of raised swirls 30 extending from lower end 26 of neck portion 12 to bottom end 28 of shoulder portion 14, although the design is not critical and any other designs may be used for the same purposes. At bottom end 28, shoulder portion 14 has an outermost diameter A. Bottom end 28 of shoulder portion 14 preferably curves slightly inwardly and is continuous with intermediate side wall portion 16, as shown in FIG. 1. However, this design is not critical to the invention disclosed herein and accordingly, intermediate side wall portion 16 may extend directly from shoulder portion 14, without any indent.

Figure 2:
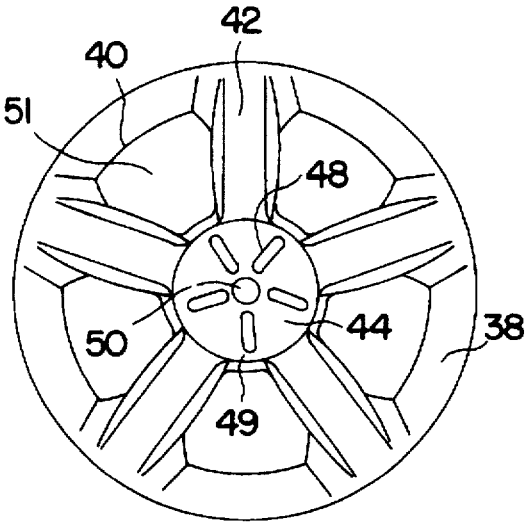
FIG. 2 is a bottom view of the container shown in FIG. 1 taken from line 2—2 of FIG. 1 showing an indent therein.
Figure 3:
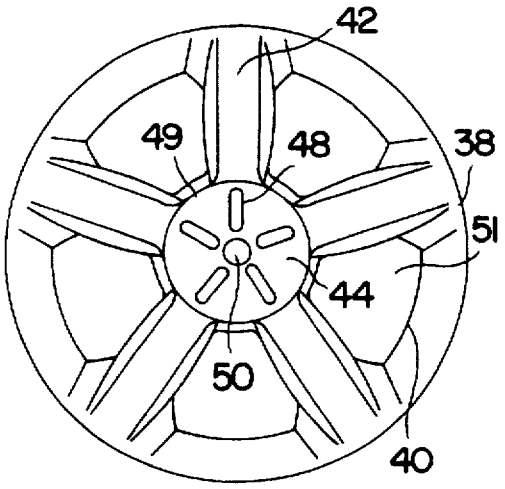
FIG. 3 is a bottom view of an alternative embodiment of the indent shown in FIGS. 1 and 2.

Intermediate side wall portion 16 is preferably substantially cylindrical in cross section and tubular in shape, as shown in FIGS. 1–3. Intermediate side wall portion 16 extends from bottom end 28 of shoulder portion 14 downwardly to base portion 18. Intermediate side wall portion 16 may have an outermost diameter B which is less than the outermost diameter A of shoulder portion 14, although, as discussed above, this is not critical to the invention disclosed herein and accordingly, the diameter of intermediate side wall portion 16 may be substantially equal to the outermost diameter of shoulder portion 14. In accordance with the above, intermediate side wall portion 16 is, therefore, formed from a substantially circular wall 32 which is formed into the cylindrical shape. However, other shapes of the wall are contemplated, and accordingly, the shape of intermediate wall portion 16 is not critical to the invention disclosed herein. Bottom end 34 of intermediate side wall portion 16 is continuous with top end 36 of base portion 18.

Figure 4:
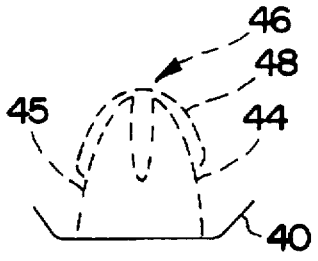
FIG. 4 is an enlarged view of another alternative embodiment of the indent.

Base portion 18 is preferably substantially cup shaped, extending slightly outwardly from the bottom of intermediate side wall portion 16, although this arrangement is not critical, downwardly and preferably tapered slightly inward to bottom end or surface 38. Base portion 18 is preferably formed through molding techniques known in the art to have a circumferential wall 39, a plurality of feet 40 separated by webs 42, as shown in FIGS. 1–3, and an axially extending indent 44 in bottom surface 38. Indent 44 extends into the volume defined by the neck, shoulder, intermediate side wall and base portions of container 10, upwardly toward the top end of container 10 and opening 20. Indent 44 is shown in FIG. 1 and FIG. 4 by dotted lines, and in the bottom views in FIGS. 2 and 3, respectively.

As shown in FIG. 1, indent 44 preferably has a cone shape although other shapes could also be used. Indent 44 is preferably small in comparison to bottom surface 38, preferably having an outer diameter 49 smaller than that of neck portion 12. By using a small sized indent, as shown, feet 40 can be used which have a size allowing for the provision of substantial stability to the container. This stability is achieved, in part, by each foot having a flattened surface 51 with a surface area having a radial and circumferential width approaching and preferably exceeding the diameter 49 of indent 44. Due to the strength enhancing texture 46 of the present invention, only an indent of this size is necessary to improve base portion strength.

Indent 44 is preferably the only axially extending indent having its origin at surface 38. Indent 44 is provided with surface texture 46 which has the function of enhancing the strength of base portion 18. The surface texture protrudes from one of exterior surface 47 (shown in FIG. 1) and interior surface 45 (shown in FIG. 4), while being grooved in the surface from which it does not protrude. That is, the surface deformations preferably extend in the form of a linear indentation and linear protrusion on exterior surface 47. As shown in FIG. 1, surface texture 46 is most preferably in the form of linear surface deformations 48 such as ribs in exterior surface 47. Linear surface deformations 48 may also be provided in the form of a plurality of dimples extending in the same manner outwardly from central point 50 and protruding from one of the interior and exterior surfaces. As shown in FIGS. 2 and 3, indent 44 has a central point 50 from or near which linear surface deformations originate, preferably in the form of ridges or grooves, and emanate outwardly toward circumferential wall 39 of base portion 18.

Accordingly, as shown in FIGS. 2 and 3, linear surface deformations 48 emanate outwardly from central point 50 and are preferably spaced uniformly along the surface of indent 44 such that the angular distance between the linear surface deformations are substantially equal. In the preferred embodiment, linear surface deformations 48 emanate from central point 50 in an arrangement such that they are aligned either with feet 40, as shown in FIG. 2, or with webs 42, as shown in FIG. 3. Accordingly, in following the linear direction of the linear surface deformations 48, linear surface deformations 48 are in alignment with feet 40 or alternatively, webs 42. However, these designs are only examples and accordingly, linear surface deformations 48 may be provided in any desired orientation which will provide the enhanced strength to be achieved by indent 44 and the surface deformations.

As can be seen from the figures, the linear surface deformations have lengths substantially defined by the small surface area of indent 44, since longer lengths are not required to obtain the desired strength enhancement. Accordingly, the surface deformations cover a very small portion of surface 38.

For example, a linear surface deformation may be provided in alignment with each of feet 40 as well as each of webs 42 such that for the container as shown, with five feet 40 and five webs 42, ten linear surface deformations are provided on indent 44. Alternatively, the linear surface deformations may be provided in alignment with neither feet 40 nor webs 42 and are simply provided emanating from central point 50 on indent 44 and preferably equal radial spacing. For example, for the container as shown with five feet 40, three, four, six, seven, eight or nine linear deformations may be provided which are equally radially spaced on indent 44 but not in alignment with either of feet 40 or webs 42.

Linear surface deformations 48, preferably in the form of grooves, ribs, or linearly arranged dimples, are formed in the same molding step in which indent 44 is formed. In accordance with the formation of linear surface deformations 48 on indent 44, enhanced strength is provided to base portion 18 such that base portion 18 is less susceptible to damage by radially directed forces, thereby preserving the stability of base portion 18 and container 10.

Container 10 is preferably formed from a thin layer of polyethylene teraphthalate (PET) although other materials may be used. For example, the container may be formed from multiple layers wherein the layers have particular functions to enhance the function of the container, such as barrier layers. Based on the design of intermediate side wall portion 16, the layer of PET may be thinner or thicker as necessary for achieving the desired strength. Since base portion 18 is provided with added strength via indent 44 it is possible that a thinner layer of material may be used in forming base portion 18 as well. Accordingly, a considerable advantage is therefore provided by the container of the present invention in that a base portion is provided which is significantly stronger than base portions of containers known in the art while not having to substantially increase the thickness of the base portion to achieve the added strength.

Figure 5:
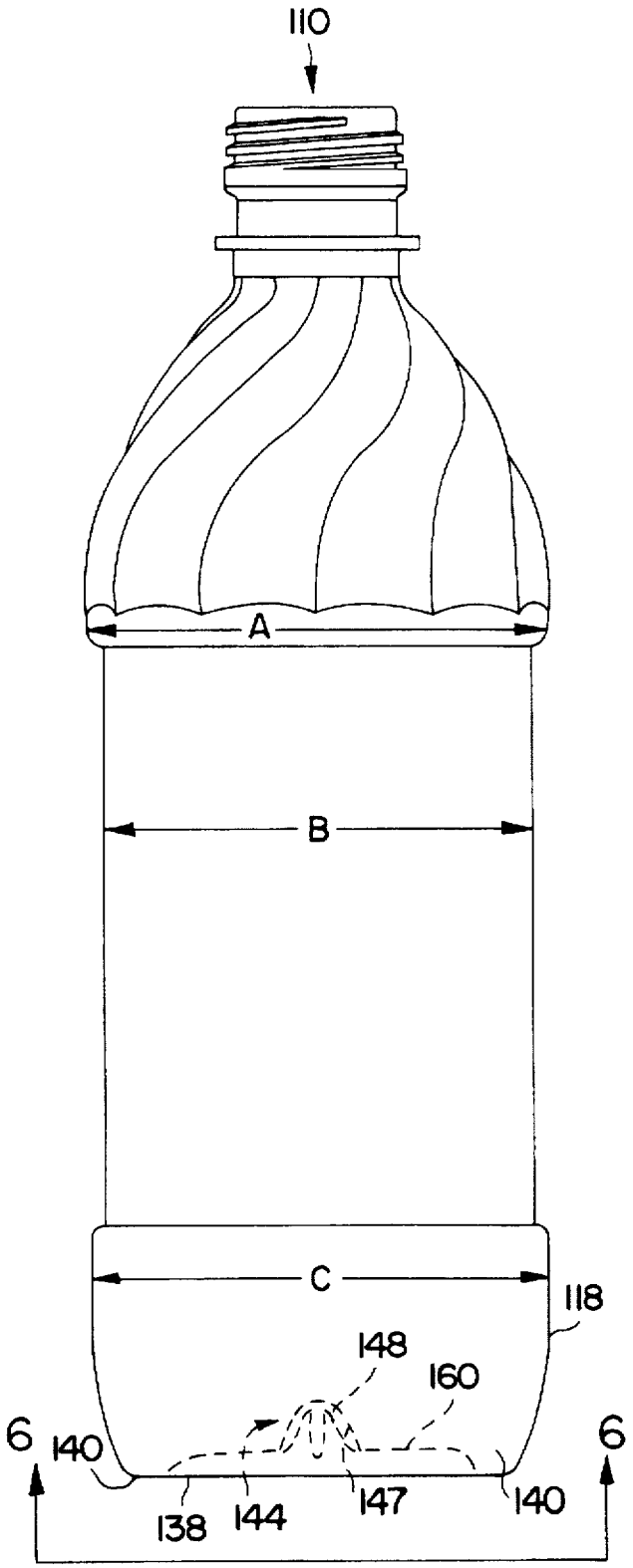
FIG. 5 is an elevational view of another embodiment of the container of the present invention.
Figure 6:
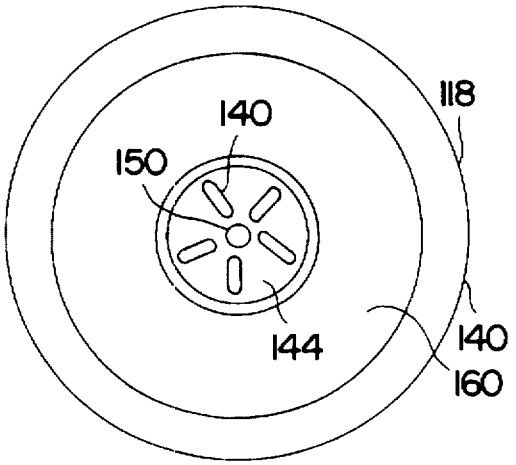
FIG. 6 is a bottom view of the container shown in FIG. 5 taken from line 6—6 of FIG. 5, showing an indent therein.
Figure 7:
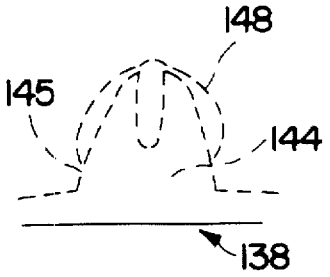
FIG. 7 is an enlarged view of an alternative embodiment of the indent for the container shown in FIG. 5.

As an alternative to the embodiment discussed above, base portion 18 may be in the form of base portion 118 for a container 110, wherein the base portion, instead of comprising a plurality of feet, comprises a singular circumferential support ring 140. Accordingly, as shown in FIGS. 5 and 6 support ring 140 in this embodiment would replace feet 40. Support ring 140 is preferably formed from relief area 160 and circumferentially extending bottom support surface 138, which is flattened for stable placement of container 110 on a support surface. Accordingly, ring 140 is continuous around the circumference of container 10 as shown. Indent 144 is preferably formed axially in relief area 160. Preferably, indent 144 and linear deformations 148 are the same as described above for container 10, as shown in FIGS. 5–7, and accordingly, the description of indent 44 and linear surface deformations 48 is hereby incorporated for indent 144. As shown in FIGS. 5–7, the linear surface deformations are preferably formed only in indent 44 and not in relief area 160. The same advantages as discussed above for container 10 with feet 40 are also applicable to container 110 with support ring 140.

Containers 10 and 110 are used as any other container. A content 52 is placed into the container and the container is sealed with a closure (not shown). Upon removing the closure, content 52 can be emptied from container 10 or 110. Because of indent 44 or 144, base portion 18 or 118, respectively, is able to withstand greater radial loads in comparison to existing containers such that the support provided by the base portions is preserved.

The primary advantage of this invention is that a container having a base portion is provided with a structural design which enhances the strength of the base portion as compared to known containers of similar structure. Another advantage of this invention is that a container having a base portion is provided for supporting the container on a support surface, which base portion includes a structural formation which enhances the strength of the base portion. Still another advantage of this invention is that a container having a base portion is provided including either a plurality of feet or a circumferential support ring for supporting the container, wherein the base portion further includes an indent central to the feet or circumferential support ring wherein the indent includes a surface structure which enhances the overall strength of the base portion. Still another advantage of this invention is that a container having a base portion including a plurality of feet or a support ring for supporting a container and an indent extending into the volume defined by the container is provided, which indent is centrally positioned with regard to the plurality of feet or circumferential ring and it includes a plurality of linear surface deformations which enhances the strength of the base portion. And still another advantage of this invention is that a container having a base portion formed from one of a plurality of feet or a circumferential support ring and an indent positioned centrally with relation to the feet and support ring is provided, which indent includes a plurality of grooves or ribs extending outwardly from a central point and toward the outer wall of the container for enhancing the strength of the base portion.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container, comprising:

a neck portion defining an opening;

a shoulder portion continuous with said neck portion;

an intermediate sidewall portion continuous with said shoulder portion, said intermediate sidewall portion defining a major portion of a volume for holding a content; and a base portion continuous with said intermediate sidewall portion, said base portion having an outer edge thereof and a structure for supporting said container on a support surface and an indentation having an outer diameter and including surface texture means thereon comprising surface deformations for enhancing the strength of said structure, wherein the outer diameter of the indentation is smaller than the neck portion opening, and including a substantially flat area between the outer edge of the base portion and the indentation to provide stability to the container, wherein said structure is comprised of one of a circumferential support ring and a plurality of circumferentially positioned feet, wherein said surface texture means for enhancing strength is substantially centered on said structure.

2. The plastic container according to claim 1, wherein said surface texture comprises of a plurality of linearly extending surface deformations.

3. The plastic container according to claim 2, wherein said indentation extends toward said neck portion and includes a central point, said linearly extending surface deformations emanating outwardly from said central point.

4. The plastic container according to claim 2, wherein a plurality of feet define said structure, and wherein at least one of said linearly extending surface deformations is provided for each of said plurality of feet.

5. The plastic container according to claim 4, wherein at least one of said linearly extending surface deformations are positioned in substantial alignment with each of said plurality of feet.

6. The plastic container according to claim 4, wherein said plurality of feet are separated by webs indented in said base portion, and wherein said linearly extending surface deformations are positioned in alignment with said indented webs.

7. The plastic container according to claim 2, wherein said base portion comprises a wall defining a further portion of said volume, said indentation extending into said further portion and including a central point, wherein said linearly extending surface deformations emanate outwardly from said central point and toward said wall.

8. The plastic container according to claim 2, wherein said linearly extending surface deformations comprise one of a plurality of linearly extending ribs and a plurality of linearly extending grooves.

9. The plastic container according to claim 8, wherein said indentation has an interior surface and an exterior surface and said linearly extending surface deformations comprise said plurality of linearly extending ribs, wherein said plurality of linearly extending ribs protrude from said exterior surface.

10. The plastic container according to claim 8, wherein said indentation has an interior surface and an exterior surface and said linearly extending surface deformations comprise a plurality of linearly extending grooves, wherein said plurality of linearly extending grooves are engrooved in said exterior surface.

11. The plastic container according to claim 2, wherein said structure is defined by a plurality of feet and said feet are separated by webs, and wherein one of said linearly extending surface deformations is provided for each of said webs.

12. The plastic container according to claim 11, wherein said linear extending surface deformations are in alignment with said webs.

13. The plastic container according to claim 12, wherein said linear surface deformations comprise one of grooves and ribs.

14. The plastic container according to claim 2, wherein said structure includes a plurality of feet each having a flattened surface with a width, wherein the width exceeds the diameter of the indentation.

* * * * *